United States Patent [19]

Katoh

[11] Patent Number: 4,475,678

[45] Date of Patent: Oct. 9, 1984

[54] ROLL FEED APPARATUS

[75] Inventor: Heizaburou Katoh, Tokyo, Japan

[73] Assignee: Sankyo Manufacturing Company, Ltd., Tokyo, Japan

[21] Appl. No.: 435,800

[22] Filed: Oct. 21, 1982

[30] Foreign Application Priority Data

Oct. 29, 1981 [JP] Japan ..... 56-163861[U]

[51] Int. Cl.[3] ..... B65H 17/26

[52] U.S. Cl. ..... 226/143; 226/165

[58] Field of Search ..... 226/142, 143, 151, 154, 226/155, 158, 165, 166, 138; 74/125.5, 126, 226/813 R, 813 C, 815–817, 822 , 116, 122

[56] References Cited

U.S. PATENT DOCUMENTS

| | | | |
|---|---|---|---|
| 4,032,056 | 6/1977 | Ito | 226/154 |
| 4,282,779 | 8/1981 | Kato | 74/822 |
| 4,304,348 | 12/1981 | Kato | 226/152 |
| 4,415,108 | 11/1983 | Katoh | 226/138 |

FOREIGN PATENT DOCUMENTS

| | | |
|---|---|---|
| 157641 | 8/1903 | Fed. Rep. of Germany . |
| 1552057 | 1/1970 | Fed. Rep. of Germany . |
| 2114432 | 9/1972 | Fed. Rep. of Germany . |
| 55-119642 | 9/1980 | Japan . |
| 1208160 | 5/1968 | United Kingdom . |

*Primary Examiner*—Leonard D. Christian

*Attorney, Agent, or Firm*—Pollock, Vande Sande & Priddy

[57] ABSTRACT

A roll feed apparatus suited for use in automatic manufacturing machines, in feeding a sheet-like material intermittently. The apparatus comprises a main sector roll and a sub-sector roll adapted to cooperate with each other in clamping therebetween the sheet-like material and in feeding the same. The main sector roll and the sub-sector roll are operatively connected to each other through sector gears. The main sector roll is operatively connected to a rocker shaft which is adapted to be rocked in rotational direction so that the main sector roll and, hence, the sub-sector roll are made to rock as the rocker shaft makes a rocking rotation. A connection device is provided for operatively connecting the main sector roll to the rocker shaft in such a manner that the rocking angle of the main sector roll for a given rocking angle of the rocker shaft is changeable. The apparatus further has a roll release device adapted to release the sheet material from the clamping by the rolls when the rolls are reversed, and a braking device for fixing the sheet material against movement during reversing of the rolls.

6 Claims, 11 Drawing Figures

ROLL FEED APPARATUS

BACKGROUND OF THE INVENTION

1. Field of the Invention

The present invention relates to a roll feed apparatus for feeding intermittently a sheet-like blank material to a processing station on a step-by-step basis. More particularly, the invention concerns a roll feed apparatus which includes a main roll and a subroll for feeding intermittently a strip-like sheet material to one or more work stations such as metallic molds in a selective manner and which is suited to be incorporated in an automated manufacturing machine or other machine tools.

2. Description of the Prior Art

The hitherto known sheet material feeding apparatus of the type described above, in which a combination of a one-way clutch and a brake or a combination of a rotating cam and a cam follower for converting a continuous rotation input to an intermittent rotation output for driving intermittently the feeding roller, suffers from many shortcomings. For instance, it is difficult, not to say impossible, to feed a strip-like blank material stepwise by a predetermined quantity with a reasonable accuracy due to backlash in a gear train, a dimensional tolerance involved in implementing the cam and cam follower mechanism. The feeding operation may not be carried out at a high speed because jamming or deformation of the sheet material being stepwise fed will be then possibly involved. Troublesome and time consuming procedures are required for adjusting the feeding apparatus for different sheet materials having different thickness. Further, it has been impossible to vary a quantity of sheet material to be fed through a single feeding step in a stepless manner without interrupting operation of the feeding apparatus as well as associated tool or tools.

In order to obviate various troubles of the conventional apparatus, the present inventors have developed and proposed improved roll feed apparatus one of which is disclosed in Japanese patent application Laid-open No. 119642/80 published on Sept. 13, 1980 and corresponding to U.S. Pat. No. 4,304,348. This improved apparatus, however, is not completely satisfactory in that it cannot provide sufficiently high precision of operation particularly when the operation speed is high, although it can eliminate the above-described problems of the prior art.

SUMMARY OF THE INVENTION

Accordingly, an object of the invention is to provide a roll feed apparatus for feeding a workpiece or sheet material intermittently, i.e. on a step-by-step basis which avoids difficulties and inconveniences of the hitherto known apparatus such as described above.

Another object of the invention is to provide a roll feed apparatus which is capable of feeding a strip-like sheet material intermittently by a predetermined quantity with an enhanced accuracy even in a high speed operation without involving jamming, deformation or the like undesirable phenomena.

A further object of the invention is to provide a sheet material feeding apparatus of the type described, in which the quantity of sheet material to be fed through a single feeding step can be varied in a stepless manner without requiring interruption in operation of the feeding apparatus.

To these ends, according to the invention, there is provided a roll feed apparatus comprising: an intermittent driving device including a rocker shaft, a roll release shaft and a brake operation shaft which are adapted to make rocking rotation independently of one another, a main roll shaft and a sub-roll shaft extending in parallel with the rocker shaft, a drive connection device through which the rocker shaft and the main roll shaft are operatively connected to each other in such a manner as to permit an adjustment of the rocking angle of the main roll shaft in relation to the rocking angle of the oscillation shaft, and a pair of sector gears attached to one end of the main roll shaft and the sub-roll shaft, the main roll shaft and the sub-roll shaft being operatively connected to each other through the sector gears; a combination of a main sector roll attached to the other end of the main roll shaft and a sub-sector roll attached to the other end of the sub-roll shaft, the main sector roll and the sub-sector roll cooperating with each other in clamping therebetween a sheet material to feed the same; a roll release device operatively connected to the roll release shaft and also to the sub-sector roll, the roll release device being adapted to move, when the rolls are rotated in the directions reverse to the feeding directions, the sub-sector roll away from the main roll thereby to release the sheet material from the clamping force; and a braking device operatively connected to the brake operation shaft and adapted to make, when said rolls are rotated in the directions reverse to the feeding directions, engagement with the sheet material thereby to fix the sheet material against movement.

The above and other objects, novel features and advantages of the invention will become more apparent from the following description of preferred embodiments taken in conjunction with the accompanying drawings.

DESCRIPTION OF THE PREFERRED EMBODIMENT

Figure 1:
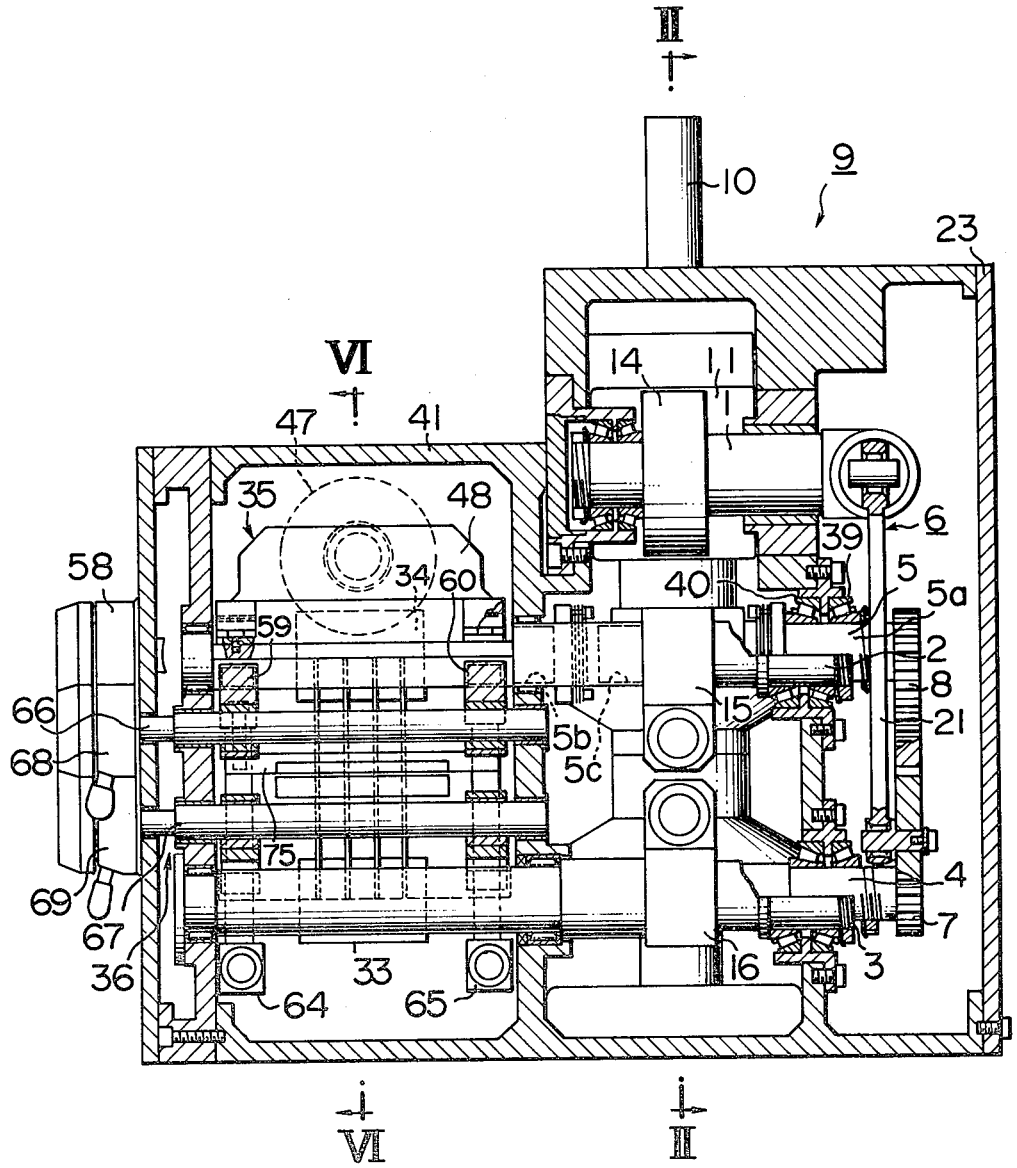
FIG. 1 is a vertical sectional view of a roll feed apparatus in accordance with an embodiment of the invention.

Referring first to FIG. 1 showing a roll feed apparatus in accordance with an embodiment of the invention, the roll feed apparatus is constituted by the following major constituents: a rocker shaft 1; a roll release shaft 2 and a brake operation shaft 3; a main roll shaft 4 and a sub-roll shaft 5 extending in parallel with the rocker shaft 1; a drive connection device 6 through which the rocker shaft 1 and the main roll shaft 4 are operatively connected to each other; and an intermittent drive device including a pair of sector gears 7 and 8 which are fixed to the right-side ends of the main roll shaft 4 and the sub-roll shaft 5 and operatively connecting these roll shafts 4, 5 to each other.

Figure 2:
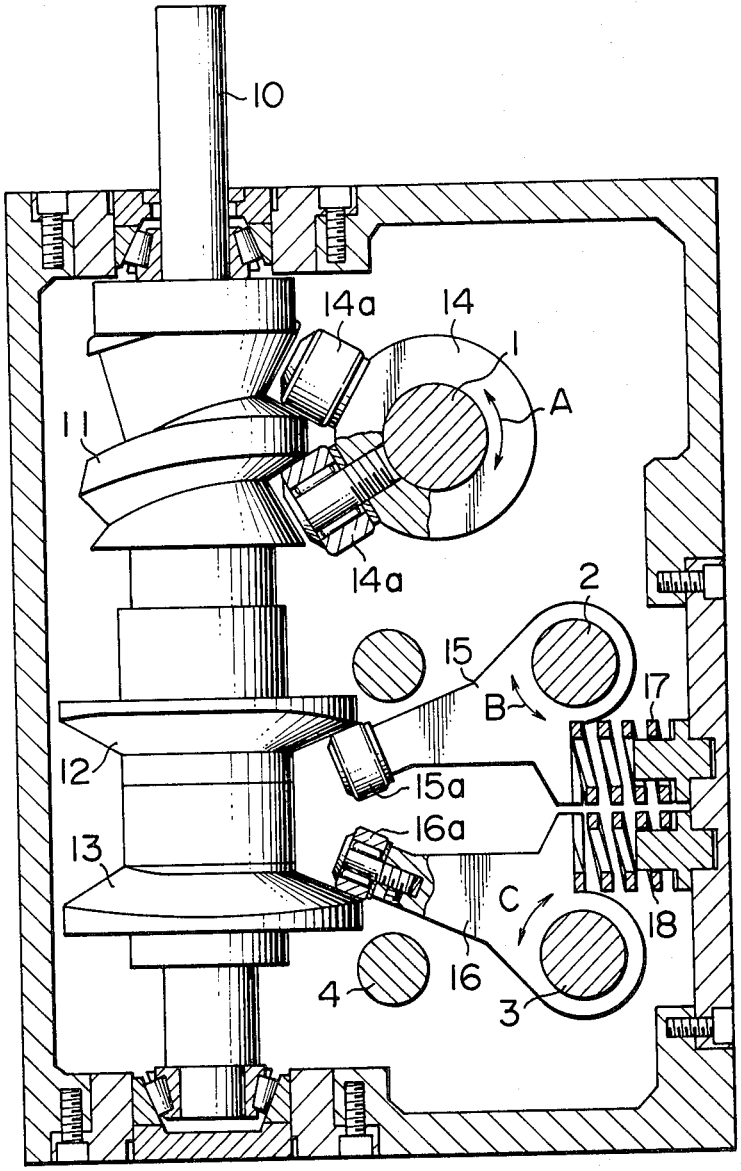
FIG. 2 is a view taken along the line II—II of FIG. 1.

As will be seen from FIGS. 1 and 2, the intermittent drive device 9 includes an input cam shaft 10 connected to a driving source such as a motor (not shown). A first cam 11, a second cam 12 and a third cam 13 are carried integrally by the input cam shaft 10. The rocker shaft 1, roll release shaft 2 and the brake operation shaft 3 are fitted to a first turret 14, second turret 15 and a third turret 16, respectively. Two rolling cam followers 14*a* are formed on the peripheral portion of the first turret 14 to project therefrom, for making rolling contact with the cam surface of the first cam 11. The arrangement is such that, while the first cam 11 continuously rotates in one direction as a unit with the input cam shaft 10, the first turret 14 and the rocker shaft 1 integral therewith makes a rocking rotary motion A in accordance with the contour of the cam surface of the first cam 11. The second turret 15 and the third turret 16 are provided with single rolling cam followers 15*a* and 16*a*, respectively. These cam followers 15*a* and 16*a* make rolling contact with the cam surfaces of the second cam 12 and the third cam 13, respectively. Therefore, while the second cam 12 and the third cam 13 rotate as a unit with the input cam shaft 10, the second turret 15 and the roll release shaft 2 integral with the latter make rocking rotary motion B following the contour of the cam surface of the second cam 12. Meanwhile, the third turret 16 and the brake operation shaft 3 integral with the latter make a rocking rotary motion c following the contour of the cam surface of the third cam 13. In FIG. 2, reference numerals 17 and 18 denote springs for pressing the rolling cam follower 15*a* of the second turret 15 and the rolling cam follower 16*a* of the third turret 16 into engagement with the cam surfaces of the second cam 12 and the third cam 13, respectively.

Figure 3:
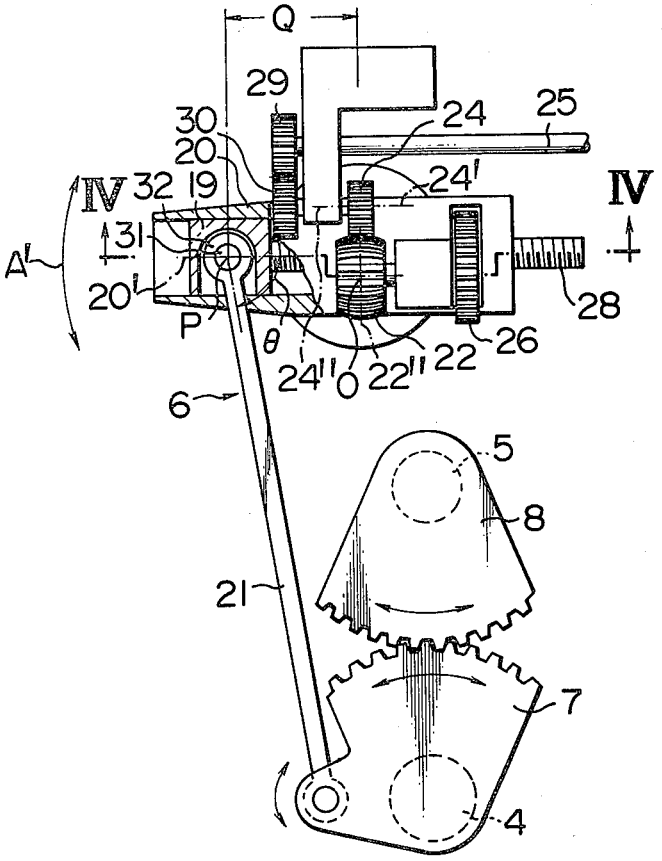
FIG. 3 is a side elevational view of a drive coupling connection device and a sector gear.
Figure 4:
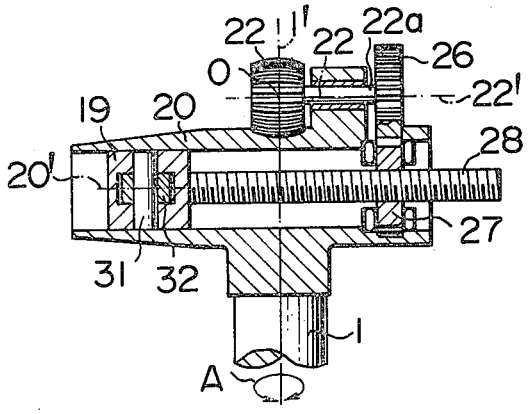
FIG. 4 is a view taken along the line IV—IV of FIG. 3.

The construction of the drive connecting device 6 and the sector gears 7, 8 will be best seen from FIGS. 3 and 4. Namely, the drive connection device 6 has a rocker member 20 extending substantially at a right angle to the rocker shaft 1 (See FIG. 4) and connected at its one end to the rocker shaft 1, the rocker member 20 accomodating a slider 19 therein, a connecting rod 21 through which the slider 19 is connected to the sector gear 7 carried by the main roll shaft 4, a crown gear 22 mounted on the rocker member 20, and a spur gear 24 rotatably carried by the housing 23 (See FIG. 1) of the intermittent drive device 9 and engaging with the crown gear 22. The above-mentioned crown gear 22 is adapted to rock together with the rocker member 20 as indicated by arrows A' when the rocker shaft 1 is rocked as a unit with the first turret 14 as indicated by arrows A. In addition, the crown gear 22 is rotatable around an axis 22' which extends perpendicularly to the plane which includes the axes 1' and 20' of the rocker shaft 1 and the rocker member 20, i.e. in the direction which extends at a right angle to the axis 1' of the rocker shaft when viewed in the plane of FIG. 4. The crown gear 22 is provided with a multiplicity of teeth 22'' formed on the spherical surface thereof centered at the point (O) of intersection between the axis 1' of the rocker shaft 1 and the axis 22' of rotation thereof. Each of the teeth 22'' extends in an arcuate form towards the axis 22' of rotation into engagement with the teeth 24' of the spur gear 24 which extends linearly in the same direction. Therefore, when the crown gear 22 is rocked around the axis 1' as indicated by arrows A', the arcuate teeth 22'' move in the direction of arc with respect to the teeth 24' of the spur gear 24, i.e. in the rocking direction. Similarly, when the spur gear 24 is rotated around the axis 24'', the crown gear 22 is rotated around the axis 22' of rotation thereof. A gear 26 is fitted to the right end of the rotary shaft 22*a* of the crown gear 22. The gear 26 is engaged by a gear 27 which is screwed to the threaded shaft 28 provided in the rocker member 20. The threaded rod 28 is fixed at its one end to the slider 19. A drive rod 25 which is connected to a motor (not shown) or the like is operatively connected to the spur gear 24 through a pair of meshing gears 29, 30. The arrangement is such that, as the spur gear 24 is rotated by the drive rod 25, the crown gear 22 is rotated as a unit with the rotary shaft 22*a* around the axis 22', so that the gear 27 is rotated through the gear 26 thereby to cause a sliding movement of the threaded rod 28 and the slider 19 in the axial direction of the rocker member 20. It is thus possible to change the rocking angle of the sector gear 7 relative to the rocking angle of the rocker member 20.

More specifically, as will be clearly understood from FIG. 4, the rocker member 20 is adapted to be rocked around the central axis 1' of the rocker shaft 1. The position of this central axis corresponds to the point (O) shown in FIG. 3. When the moved 19 is slided, the distance Q between the point P (See FIG. 3) of connection between the rocker member 20 and the connecting rod 21 and the above-mentioned point O is changed to vary the angle $\theta$ of inclination of the connecting rod 21 to the axis 20'. In consequence, the rocking angle of the sector gear 7 and, hence, the rotation angle of the main roll shaft 4 for a given rocking angle of the rocker member 20 are varied. Since the sector gear 7 engages with the sector gear 8 which in turn is fixed integrally to the sub-roll shaft 5, the change in the rocking angle of the sector gear 7 causes a change in the rocking angle of the sector gear 8. The main roll shaft 4 and the sub-roll shaft 5 are rotated always by an equal rotation amount. By changing the rocking angle of the main roll shaft 4 and sub-roll shaft 5 with respect to the rocking angle of the rocker shaft 1 and rocker member 20 integral with the latter, the rocking angle of the main sector roll 33 and sub-sector roll 34 are also varied so that the amount of feed of the sheet material in each cycle of intermittent feed by the roll feed apparatus is varied as will be explained later.

In FIGS. 3 and 4, reference numerals 31 and 2 denote, respectively, a fixed pin provided on the slider 19 and a bearing member rotatably fitting around the pin. The slider 19 and the connecting rod 21 are connected to each other through the pin 31 and the bearing member 32. A similar connecting mechanism is employed for the connection between the connecting rod 21 and the sector gear 7.

Hereinunder, an explanation will be made as to the main sector roll 33, sub-sector roll 34, roll release device 35 and the brake operation device 36 which are driven by the intermittent drive device 9, with specific reference to FIG. 1 and FIGS. 5 thru 11.

As will be clearly understood from FIG. 1, the main sector roll 33 is integrally fixed to the left portion of the main roll shaft 4. The sub-roll shaft 5 consists of a right portion the right end of which fits in the sector gear 8, a left roll supporting portion 5*b* and an intermediate portion 5*c* therebetween. A sub-sector roll 34 is fixed integrally to the left roll supporting portion 5*b*. More specifically, the right portion 5*a* and the intermediate portion 5*c* are connected to each other through a coupling 37, while the connection between the intermediate portion 5*c* and the roll supporting portion 5*b* is achieved by a coupling 38. See FIG. 9. As will be detailed later, the roll supporting portion 5*b* of the sub-roll shaft 5 is adapted to be moved toward and away from the main sector roll 33 as a unit with the sub-sector roll 34. However, the right portion 5*a*, which is supported by the housing 23 of the intermittent driving device 9 through bearings 39 and 40, cannot move together with the roll supporting portion 5*b*. The aforementioned couplings 37 and 38, therefore, are constructed to permit the above-mentioned movement of the roll supporting portion 5*b* with respect to the right portion 5*b* which is fixed by means of the bearings 39 and 40.

Throughout the specification, the terms "sector gear" and "sector roll" are used to mean gears and rolls having substantially sector-shaped cross-section. Namely, in the present invention, the gears 7, 8 and the rolls 33, 34 are made to have sector shapes because they are intended for rocking motion. By the adoption of the sector shape, the weights of the gears and rolls and, hence, the inertia of movable parts during operation of the roll feed apparatus are reduced advantageously as compared with the case where the gears and rolls have circular cross-sections. This is quite advantageous for the speed of feed of the sheet material in the high speed operation of the roll feed apparatus.

As will be clearly understood from FIGS. 1, 5, 6 and 8, the main sector roll 33 in the illustrated embodiment has a boss 33*a* (See FIG. 8) fitted around the main roll shaft 4, four sector-shaped plates $33b_1$ to $33b_4$ extended radially outwardly from the boss 33*a* and a peripheral plate 33*c* which connects the outer peripheral edges of the plates. Similarly, the sub-sector roll 34 has a boss 34*a* fitted around the roll supporting portion 5*b*, four sector-shaped plates $34b_1$ to $34b_4$ extending radially outwardly from the boss 34*a* and a peripheral plate 34*c* connecting the peripheral edges of the sector-shaped plates $34b_1$ to $34b_4$. By adopting hollow skeleton-like construction of the main sector roll and the sub-sector roll, the weight is much reduced to ensure higher precision of feed of the sheet material as compared with the case where the rolls have solid construction.

Figure 5:
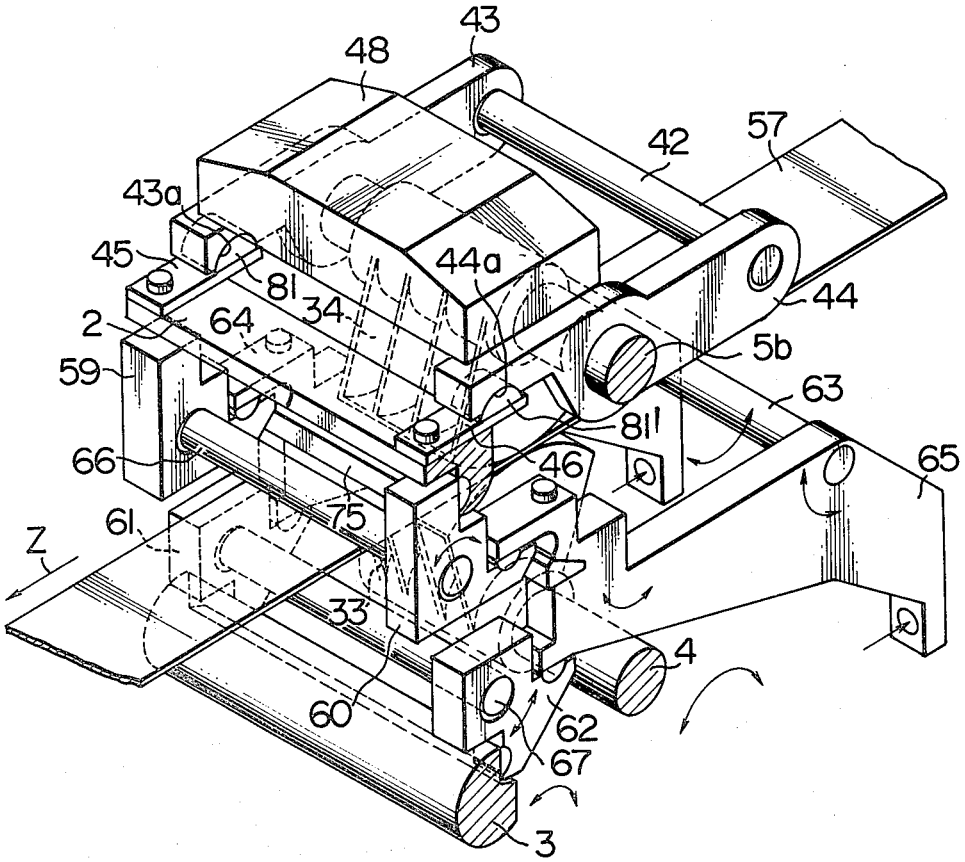
FIG. 5 is a perspective view of the roll feed apparatus, showing particularly a main sector roll and a sub-sector roll, as well as the portions around these rolls.
Figure 6:
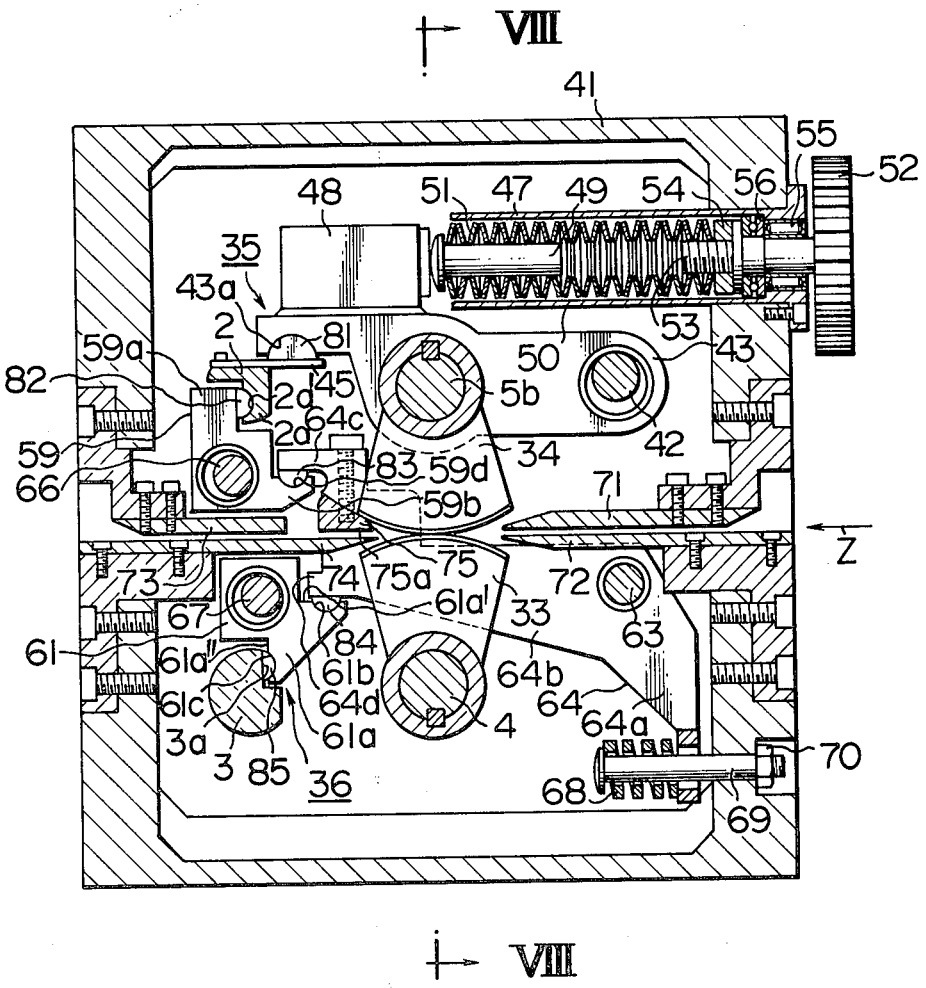
FIG. 6 is a view taken along the line VI—VI of FIG. 1.
Figure 8:
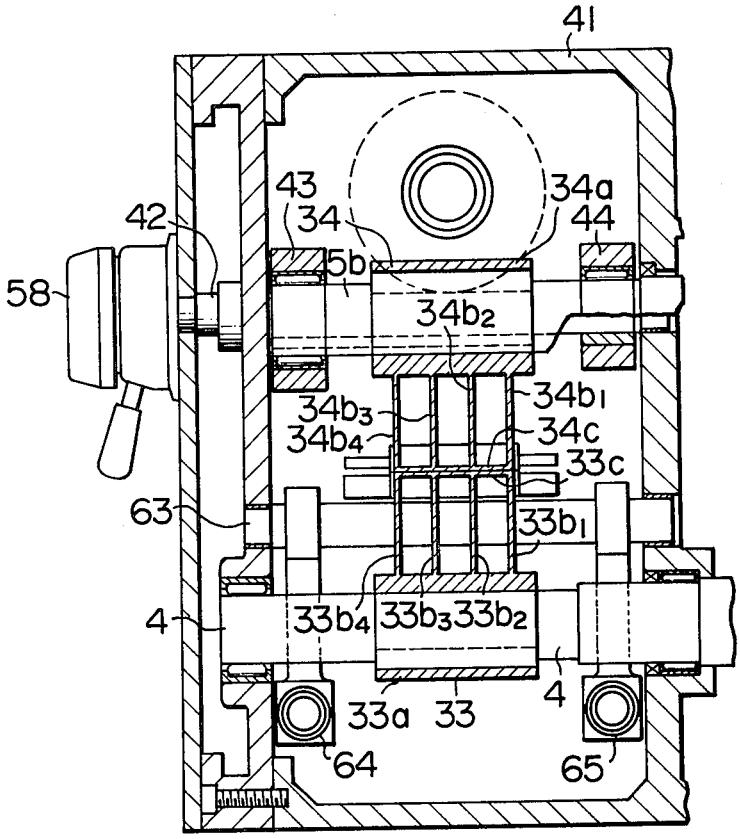
FIG. 8 is a view taken along the line VIII—VIII of FIG. 6.

As specifically shown in FIGS. 5, 6 and 8, the roll release device 35 includes a pair of release arms 43 and 44 which are positioned at both sides of the sub-sector roll as viewed in the direction of axis of the sub-sector roll 34 and extending in the planes perpendicular to the axis of the sub-roll shaft 5, a pair of release operation plates 45 and 46 fixed to the roll release shaft 2 and projecting to the lateral sides of the roll release shaft 2 to the areas under respective release arms 43, 44, and a pressurizing device 47. The right ends of the release arms 43 and 44 (See FIGS. 5 and 6) rotatably fit in the first eccentric shaft 42 which extends in parallel with the sub-roll shaft 5. The longitudinal central portion of the release arm rotatably fits in the roll supporting portion 5*b* of the sub-roll shaft 5. Semi-cylindrical coupling receivers open to the lower side, i.e. recesses 43*a* and 44*a*, are formed in the left ends (See FIGS. 5 and 6) of the release arm 43 and 44. These recesses 43*a* and 44*a* are coupled to the free end portions of the release operation plates 45 and 46, through semi-cylindrical coupling members 81 and 81', respectively.

Figure 10:
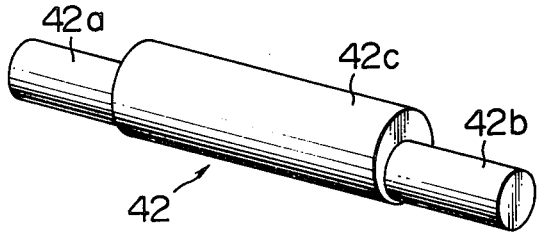
FIG. 10 is a perspective view showing an eccentric shaft.

As shown in FIG. 10, the eccentric shaft 42 has small-diameter end portions 42*a*, 42*b* and a large-diameter intermediate portion 42*c* the axis of which has an eccentricity with respect to the axis of the small-diameter end portions 42*a*, 42*b*. The small-diameter end portions 42*a*, 42*b* of the eccentric shaft 42 are rotatably supported by the roll housing 41, while the right ends (See FIGS. 5 and 6) of the release arms 43, 44 rotatably fit around the large-diameter intermediate portion 42*c*. One of the small-diameter ends projects to the outside of the roll housing 41. An adjusting dial 58 (See particularly FIG. 8) is fixed to the projected smaller-diameter end of the eccentric shaft 42. The arrangement is such that, as the adjusting dial 58 is rotated to cause a rotation of the eccentric rod 42 around the axis of the small-diameter ends 42*a*, 42*b* in the clockwise direction as viewed in FIGS. 5 and 6, the right end of the release arms 43, 44 fitting around the eccentric large-diameter intermediate portion 42*c* is moved upwardly, so that the roll supporting portion 5*b* of the sub-roll shaft 5 and the sub-sector roll 34 are moved upwardly as viewed in FIGS. 5 and 6 as a unit with the release arms 43 and 44, thereby to increase the clearance between the subsector roll 34 and the main sector roll 33. As the adjusting dial 58 is further rotated in the same direction or in the reverse direction, the clearance between the rolls 33 and 34 is decreased. It is, therefore, possible to optimize the clearance between two rolls to suit the same for the thickness of the sheet material which is to be clamped and fed by these rolls.

The release arms 43 and 44 arranged in a pair are connected integrally to each other by means of a block 48 positioned at the top of the left positions (FIGS. 5 and 6) thereof. This block 48 is biased to the left (See FIGS. 5 and 6) by a pressing pin 49. Namely, the pressurizing device 47 has a tubular member 50 which accommodates a spring 51 by which the pressing pin 49 is biased to the left as viewed in FIG. 6.

The pressurizing device 47 includes a gear 52, and a threaded rod 53 which is mounted in the tubular member 50 through the medium of bearings 55 and 56. The threaded rod 53 is fixed at its outer end to the gear 52 and immovable in the axial direction of the tubular member 50. The pressurizing device 47 further has a nut 54 screwed to the threaded rod 53. The gear 52 is adapted to be rotated by a motor or the like which is not shown. The arrangement is such that, as the gear 52 and the threaded rod 53 integral therewith are rotated, the nut 54 is moved in the axial direction of the tubular member 50 thereby to load or unload the spring 51. By adjusting the force of the spring 51 through suitably selecting the direction and amount of rotation of the gear 52, it is possible to optimize the leftward force (See FIG. 6) exerted on the block 48 through the pressing pin 49.

As will be clearly seen from FIGS. 5 and 6, when the block 48 is urged leftwardly, the release arms 43 and 44 are pressed to rock counter-clockwise around the eccentric shaft 42, so that the sub-sector roll 34, which is connected to the release arms 43, 44 through the roll supporting portion 5*b* of the sub-roll shaft 5, is pressed downwardly toward the main sector roll 33. It is thus possible to optimumly control the contact pressure between the sub-sector roll 34 and the main sector roll 33 and the sheet material 57 clamped therebetween, by varying the downward pressing force exerted on the sub-sector roll 34 through adjustment of the spring 51.

The brake device 36 is constituted by the following parts: a pair of first adjusting blocks 59 and 60 disposed at both sides of the roll release shaft 2 and opposing to release operation plates 45 and 46; a pair of second adjusting blocks 61 and 62 opposing to the first adjusting blocks 59 and 60, respectively, across the path of feed of the sheet material; and a pair of brake arms 64 and 65 rotatably fitting around a support shaft 63 which is fixed at its both ends to the roll housing 41. The first adjusting blocks 59, 60 and the second adjusting blocks 61, 62, respectively, are rotatably fitted around a second eccentric shaft 66 and a third eccentric shaft 67 which extend in parallel with the brake operation shaft 3.

The second and third eccentric shafts are constructed substantially in the same manner as the first eccentric shaft 42 shown in FIG. 10. The smaller diameter ends of each of the second and third eccentric shafts are rotatably carried by the roll housing 41. The first adjusting blocks 59, 60 and the second adjusting blocks 61, 62 are rotatably fitted around the large-diameter intermediate portions of the second and third eccentric shafts. As will be clearly seen from FIG. 1, the left end of the second eccentric shaft 66 projects to the outside of the roll housing 41, and an adjusting dial 68 is fixed to this projected end. Similarly, the left end of the third eccentric shaft 67 projects to the outside of the roll housing, and an adjusting dial 69 is fixed to this projecting end. It is possible to adjust the positions of the first adjusting blocks 59, 60 and the second adjusting blocks 61, 62 by rotating the second and third eccentric shafts by means of the adjusting dials 68 and 69.

Hereinafter, a detailed explanation will be made as to the brake arm 64, first adjusting block 59 and the second adjusting block 61 shown at left-side portion of FIG. 5, with specific reference to FIG. 6. As will be clearly understood from the comparison between FIGS. 5 and 6, the arrangement concerning the release arm 44, release operation plate 46, brake arm 65, first adjusting block 60 and the second adjusting block 62, all of which are shown at the right-side portion of FIG. 5, is materially identical to that of the release arm 43, release operation plate 45, brake arm 64, first adjusting block 59 and the second adjusting block 61 which are shown at the left-side portion of FIG. 5. The detailed description, therefore, is omitted as to the brake arm 65, first adjusting block 60 and the second adjusting block 62 shown at the right-side portion in FIG. 5.

As will be seen from FIG. 6, the brake arm 64 has a leg 64*a* which extends downwardly from the portion thereof around the support shaft 63, and a horizontal arm 64*b* which extends substantially horizontally from the portion thereof near the support shaft 63. A bolt 69 having a spring 68 fitted around left portion thereof is inserted into the lower end of the leg 64*a*. The right end of the bolt 69 is fixed to the roll housing 41 by means of a nut 70. Therefore, the brake arm 64 is biased by a spring 68 to rotate around the supporting shaft 63 in the counter-clockwise direction. The left end of the horizontal arm 64*b* is branched into an upper portion 64*c* which projects to the area above the path of feed of the sheet material leftwardly toward the first adjusting block 59 and a lower portion 64*d* positioned below the path of feed of the sheet material and extending toward the second adjusting block 61.

The first adjusting block 59 has an upward projecting portion 59*a* extending upwardly as viewed in FIG. 6 into the notch formed in the roll release shaft 2, and a rightward projecting portion 59*b* which extends substantially at a right angle to the upward projection 59*a* into the region below the upper portion 64*c* of the brake arm 64. A semi-cylindrical coupling receiving portion, i.e. a recess 2*a*', is formed in the downward projection 2*a* of the roll release shaft 2. A semi-cylindrical coupling member 82 is mounted between the right wall surface of the upward projection 59*a* and the recess 2*a*'. Similarly, a semi-cylindrical coupling 83 is connected between the recess 59*d* and the upper portion 64*c* of the brake arm 64. The second adjusting block 61 has a substantially triangular projection 61*a* provided with an upper surface 61*a*' beneath the lower portion 64*d* of left end of the brake arm 64 and a left surface 61*a*'' extending into the notch of the brake operation shaft 3. The above-mentioned upper surface 61*a*' has a semi-cylindrical coupling receiving portion, i.e. a recess 61*b*. A coupling member 84 is connected between the recess 61*b* and the lower portion 64*d* of the brake arm 64. A similar semi-cylindrical coupling receiving portion, i.e. a recess 61*c*, is formed also in the above-mentioned left surface 61*a*''. A semi-cylindrical coupling member 85 is connected between the recess 61*c* and the surface 3*a* of notch of the brake operation shaft 3.

In FIG. 6, reference numerals 71 and 72 designate a pair of guide plates fixed to the roll housing 41 at the upstream side of the main sector roll 3 and the sub-sector roll 34 as viewed in the direction of the movement of the sheet material, while numerals 73 and 74 denote a pair of guide plates fixed to the roll housing 41 at the downstream side of the rolls 33, 34 as viewed in the direction of movement of the sheet material. As will be seen from FIG. 5, sheet material is fed in the direction of an arrow Z past the space between the guide plates 71 and 72 and the space between the guide plates 73 and 74. In FIGS. 5 and 6, a reference numeral 75 denotes a brake pad. The brake pad 75 is fixed at its one end by a bolt to the lower portion of the upper part of the aforementioned upper portion 64*c* at the left side portion in FIG. 5 and at its other end to the corresponding portion of another brake arm 65 which is shown at the right-side portion in FIG. 5. The brake pad 75 has a lower surface 75*a* which opposes to the upper surface of the guide plate 74. When the brake arms 64 and 65 are swung in the counter-clockwise direction as viewed in FIGS. 5 and 6 to the position shown in FIG. 7, the lower surface 75*a* of the brake pad 75 makes a frictional engagement with the upper surface of the sheet material 57 (See FIG. 5) so that the sheet material 75 is locked between the lower surface 75*a* of the brake pad 75 and the upper surface of the guide plate 74.

Figure 11:
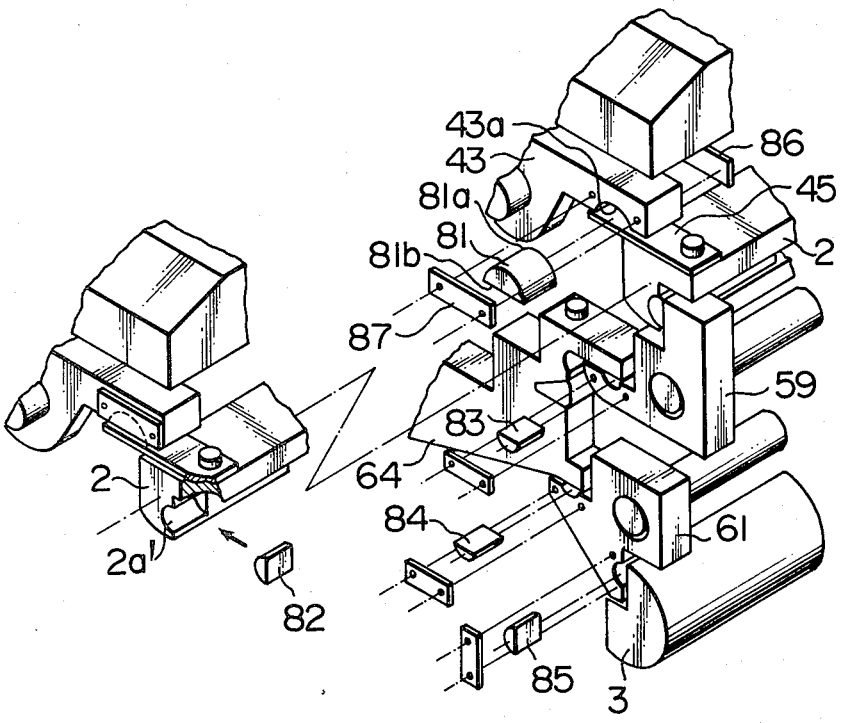
FIG. 11 is an exploded perspective view showing the manner of mounting of a semi-cylindrical coupling member.

FIG. 11 shows how the semi-cylindrical coupling members 81 thru 85 are mounted. Namely, the coupling member 81 is positioned between the free end portion of the release operation plate 45 and the recess 43*a*, with its cylindrical surface 81*a* engaging the recess 43*a* while the flat surface thereof is held in engagement with the upper surface of the release operation plate 45. Then, a pair of retainer plates 86 and 87 are secured by means of bolts to both sides of the release arm 43 thereby to fix the coupling member 81 against movement in the axial direction. Therefore, as the release arm 43 is rotated in accordance with the rotation of the release operation plate 45 as a unit with the roll release shaft 2, a relative rotary motion is caused between the cylindrical surface 81*a* of the coupling member 81 and the surface of the recess 43*a* and, at the same time, the flat surface 81*b* is slightly slided in the longitudinal direction of the release operation plate 45.

The semi-cylindrical coupling members 83 thru 85 are mounted at respective portions in the same manner as the coupling member 81. The coupling member 82 also is mounted substantially in the same manner as the coupling member 81. In this case, however, no member corresponding to the retainer plates 86 and 87 are necessary because both axial ends of the recess 2*a*′ formed in the roll release shaft 2 are kept closed.

The roll feed apparatus of the illustrated embodiment, having the construction hereinbefore described, operates in a manner explained hereinunder. Namely, as the input cam shaft 10 (particularly the first and second ones) is driven to rotate continuously, the rocker shaft 1 makes a rocking rotation as indicated by arrows A as a unit with the first turret 14 in accordance with the contour of the surface of the first cam 11. The rocking rotation of the rocker shaft 1 is transmitted to the main roll shaft 4 through the drive connection device 6 (See FIGS. 1, 3 and 4) and the sector gear 7, and also to the sub-roll shaft 5 through the sector gears 7 and 8. Therefore, the main sector roll 33 and the sub-sector roll 34 (See FIGS. 1, 5 and 6, particularly) attached to the main roll shaft 4 and the sub-roll shaft 5 are made to rock together with these shafts 4 and 5.

During the rocking, the rocker shaft 1 makes a temporary stop at each of the ends of the rocking stroke. Namely, the rocker shaft 1 performs repetitional cycles each including rotation in one direction, temporary suspension of rotation, rotation in the reverse direction and temporary suspension of rotation. In consequence, the main roll shaft 4 and the sub-roll shaft 5, as well as the main sector roll 33 and the sub-sector roll 34 fixed to these shafts 4 and 5, make similar repetitional rocking cycles. This operation will be explained hereinunder with reference to FIG. 6. The main sector roll 33 makes repetitional cycles each of which consists of rotation in the counter-clockwise direction, temporary suspension of rotation, rotation in the clockwise direction and temporary suspension of rotation. Therefore, by making both rolls 33 and 34 clamp therebetween the sheet material 57 (See FIG. 5) while these rolls rotate in respective directions, i.e. while the main sector roll 33 and the sub-sector roll 34 rotate in the counter-clockwise direction and clockwise direction, respectively, the sheet material 57 is fed in the direction of the arrow Z by an amount corresponding to the amounts of rotation of the rolls. Thereafter, during the temporary suspension of rotation of two rolls, the sub-sector roll 34 is raised apart from the sheet material 57 and both rolls are reversed in this state, namely, the main sector roll 33 and the sub-sector roll 34 are rotated clockwise and counter-clockwise, respectively. During the reversing of the rolls, the sheet material 57 is kept stationary. During the suspension of rotation after the reversing of the rolls, the sub-sector roll 34 is lowered towards the main sector roll 33 into friction contact with the sheet material 57. The sheet material 57 is then fed again in the direction of the arrow Z as the rolls rotate in the first-mentioned directions.

In order to intermittently feed the sheet material 57 in the direction Z, it is necessary to move the sub-sector roll 34 toward and away from the main sector roll 33 in the timing explained above. This movement of the sub-sector roll 34 and the secure lock of the sheet material during suspension of feed are performed by the roll release apparatus 35 (See particularly FIGS. 1, 5 and 6) and the braking device 36, in a manner explained hereinunder.

Namely, during suspension of rotation of the main sector roll 33 and the sub-sector roll 34 after the rotation in the first-mentioned directions, the roll release shaft 2 and the brake operation shaft 3 are rotated by a predetermined amount in the counter-clockwise direction as viewed in FIGS. 5 and 6. Therefore, the release arms 43 and 44 are pivoted around the eccentric shaft 42 in the clockwise direction, so that the roll supporting portion 5*b* of the sub-roll shaft 5 and the sub-sector roll 34 attached to the roll supporting portion 5*b* are raised away from the main sector roll 33. The first adjusting blocks 59, 60 and the second adjusting blocks 61, 62 are rotated clockwise around the second eccentric shaft 66 and the third eccentric shaft 67. Consequently, the brake arms 64 and 65 are pivoted counter-clockwise around the supporting shaft 63 to take the positions shown in FIG. 7. More specifically, the brake arm 64 is pivoted in the counter-clockwise direction by the force of the spring 68, while the brake arm 65 is pivoted by the force of a spring which is not shown. In the state shown in FIG. 7, the sub-sector roll 34 is spaced away from the main sector roll 33 and the sheet material 57 (See FIG. 5), so that the sheet material 57 is locked by the guide plate 74 and the brake pad 75 against movement.

Figure 7:
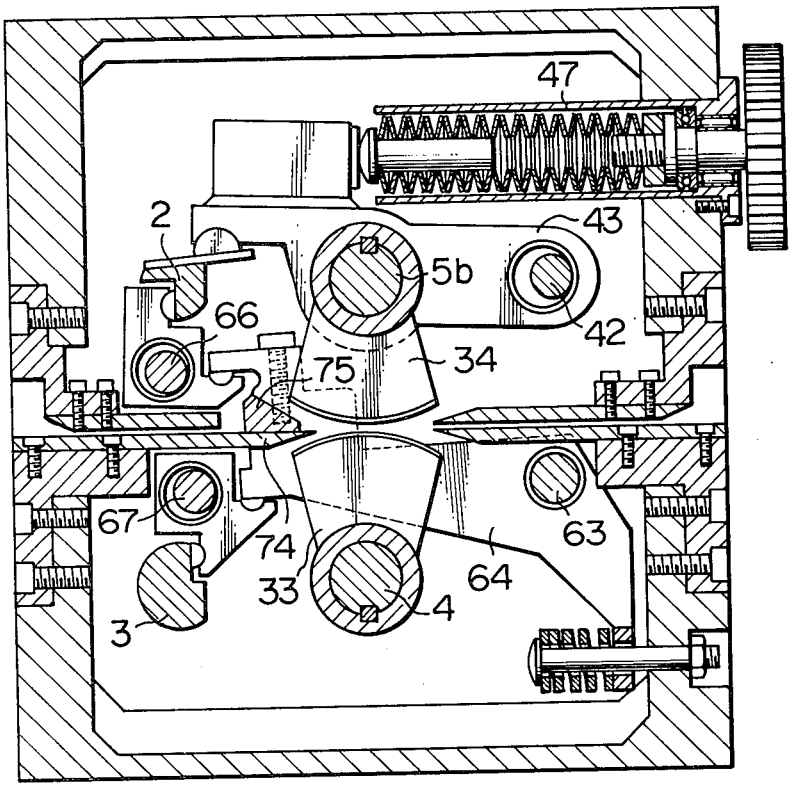
FIG. 7 is a view similar to that in FIG. 6 but shows a state in which the sub-sector roll is separated from the main sector roll, while the sheet material is locked by a brake device.
Figure 9:
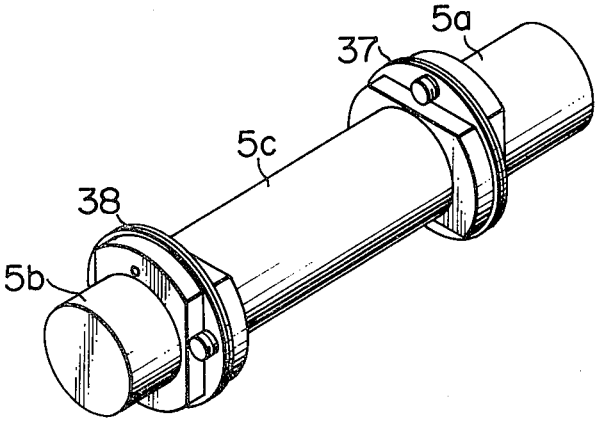
FIG. 9 is a perspective view showing the arrangement of the sub-roll shaft.

The reversing of the rolls 33 and 34 is made in the state shown in FIG. 7. Therefore, the sheet material 57 is kept stationary without fail during the reversing of the rolls 33 and 34. When the rotation of the rolls is stopped after the reversing, the roll release shaft 2 and the brake operation shaft 3 are rotated clockwise as viewed in FIG. 7. As a result, the release arms 43 and 44 are pivotally moved by the pressurizing device 47 in the counter-clockwise direction as viewed in FIG. 7, while the brake arms 64, 65 are rotated clockwise around the supporting shaft 63 to take the state shown in FIG. 6. Therefore, during the subsequent rotation of the rolls 33, 34 in the first-mentioned directions, the sheet material 57 is fed in the direction shown by the arrow Z.

As stated before, the rotor release shaft 2 and the brake operation shaft 3 are integrally fixed to the second turret 15 and the third turret 16 (See particularly FIG. 2), so that these shafts making rocking rotary motions as indicated by arrows B and C, respectively, in conformity with the contours of the cam surfaces of the second cam 12 and the third cam 13, as the input cam shaft 10 is rotated continuously. Therefore, by suitably designing the cam countours of the second cam 12 and the third cam 13, it is possible to attain the rocking rotation of the roll release shaft 2 and the brake operation shaft 3 in the timing explained above.

As has been described, in the illustrated embodiment of the invention, the release arms 43, 44 (See particularly FIGS. 5 and 6), first adjusting blocks 59, 60 and the second adjusting blocks 61, 62 are rotatably fitted around the first eccentric shaft 42, second eccentric shaft 66 and the third eccentric shaft 67, respectively. This arrangement makes it possible to optimize the clearance between the rolls 33 and 34 in relation to the thickness of the sheet material to be clamped and fed, through controlling the positions of the release arms 43, 44, first adjusting blocks 59, 60 and the second adjusting blocks 61, 62, by rotating the eccentric shafts 42, 66 and 67, and also to optimize the clearance between the brake pad 75 and the guide plate 74 (See FIG. 6) in accordance with the thickness of the sheet material. In addition, by a provision of the pressurizing device 47 of the type illustrated, it is possible to downward pressing force for urging the sub-roll 34 towards the sector roll 33 and, hence, the clamping force of the rolls 33 and 34 on the sheet material clamped therebetween, by adjusting the leftward pressing force (As viewed in FIG. 6) exerted by the pressing pin 49 on the block 48. Consequently, it is possible to attain a smooth and reliable feed of the sheet material.

In the illustrated embodiment, a combination of a semi-cylindrical coupling member and a semi-cylindrical coupling receiving member, i.e. a recess, rotatably receiving the coupling member is used in each of the connections between the release operation plates 45, 46 and the release arms 43, 44, between the roll release shaft 2 and the first adjusting blocks 59, 60, between the first adjusting blocks 59, 60 and the brake arms 64, 65, between the second adjusting blocks 61, 62 and the brake arms 64, 65 and between the second adjusting blocks 61, 62 and the brake operation shaft 3. Therefore, the relative motion between the members constituting the connections is never affected adversely even when the positions of the release arms, first adjusting blocks and the second adjusting blocks are varied as a result of rotation of the first to third eccentric shafts 42, 66 and 67.

As will be understood from the foregoing description, in the roll feed apparatus of the invention, the sheet material clamped between the main sector roll and the sub-sector roll is fed intermittently in one direction to different working positions successively. Particularly, the apparatus of the invention is characterized in that the main roll shaft 4 and the sub-roll shaft 5 are operatively connected to each other through sector gears 7, 8 such that the main sector roll 33 and the sub-sector roll 34 are rocked rotatively as a unit with these shafts 4 and 5, and that the roll release device 35 and the braking device 36 cooperate with each other in such a way that, while permitting the feed of the sheet material during rotation of the rolls 33, 34 in first directions, the sheet material is locked securely during the rotation of the rolls in the second directions.

Generally, in the roll feed apparatus of the kind described, only the main roll is driven while the sub-roll is merely supported rotatably in the roll housing. Namely, in the known roll feed apparatus of the kind described, only the main roll is power driven while the sub-roll is rotated indirectly through frictional engagement with the sheet material. This type of apparatus, however, suffers from a problem that the precision of feed is deteriorated due to possible slip between the sheet material and the main roll.

In the known roll feed apparatus of the kind described, the intermittent feed of the sheet material in one direction is performed by an intermittent driving of the main roll. This intermittent driving of the main roll has been achieved by, for example, a mechanism having a cam adapted to directly drive the main roll shaft 4 without assist by any constituents corresponding to the rocker shaft 1 and the drive connection device 6 incorporated in the apparatus of the invention. According to such a known arrangement, the pattern of intermittent rotation of the main roll shaft and the main roll integral therewith is unfavourably determined by the contour of the cam, so that the pattern of intermittent driving cannot be changed unless the cam is exchanged. Therefore, this type of known apparatus is quite unsuited to the use in automatic manufacturing machines for large-lot and large quantity production as well as in large-lot small quantity production. Namely, if the pattern of intermittent rotation of the main roll is not changeable, there is no means for varying the amount of feed of the sheet material in the intermittent feed of the same. For suiting the apparatus for the production of different kinds of products, it is necessary to vary the amount of feed to ensure the feed of the material to different positions where different machine tools are installed. Such an adjustment cannot be made in the known apparatus of the type mentioned before.

In order to obviate this problem, the present inventors have already proposed improved roll feed apparatus one of which is disclosed in the Japanese patent application, Laid-Open No. 119642/80 mentioned before. Namely, this apparatus has a rocker shaft, connection mechanism and a main roll shaft similar to those 1, 6 and 4 in the apparatus of the invention. In this improved apparatus, the pattern of rocking motion of the main roll shaft in relation to the rocking motion of the rocker shaft is changeable by an adjustment of the drive connection device 6. In addition, the transmission of the torque from the main roll shaft to the main roll is made only for one direction of rotation of the main roll shaft to ensure an intermittent rotation of the main roll in one direction. This improved apparatus offers an advantage that the pattern of intermittent rotation of the main roll is changed by varying the pattern of rocking rotation of the main roll shaft thereby to permit an easy control of amount of intermittent feed of the sheet material as desired.

This improved apparatus, however, is still unsatisfactory in that a complicated mechanism is required for converting the rocking motion of the main roll shaft into the intermittent rotation of the main roll and that desired precision of operation cannot be achieved particularly when the roll feed apparatus is operated at a high speed.

In view of the above-described shortcomings of the prior art, in the apparatus of the invention, the rocking motion of the main roll shaft 4 is directly transmitted to the main sector roll 33, and the main roll shaft 4 and the sub-roll shaft 5 are operatively connected to each other through the sector gears 7 and 8, thereby to cause rocking motion of both of the main sector roll 33 and the sub-sector roll 34. In addition, a roll release device 35 and the braking device 36 are provided for cooperation with each other in such a manner as to permit the sheet material to be fed without fail when the rolls 33, 34 rotate in one directions while securely stationing the same when the rolls rotate in the reverse directions. This arrangement is quite effective in enhancing the precision of operation of the roll feed apparatus. Furthermore, since the rolls are intended for rocking rotary motion, it is not necessary to use rolls having circular cross-sections. According to the invention, therefore, sector-shaped rolls are used as the main roll 33 and the sub-roll 34, and sector gears 7, 8 are used for operatively connecting the main roll shaft 4 and the sub-roll shaft 5. The use of such sector-shaped movable parts advantageously decreases the inertia of mass during the operation of the roll feed apparatus thereby to enhance the precision of feed of the sheet material as explained before.

It is also to be pointed out that, by the use of the intermittent driving device 9 incorporating cams and turrets, it is possible to achieve highly precise rocking rotation of the main roll shaft 4 and the sub-roll shaft 5 and to transmit the rocking rotation to the main sector roll 33 and the sub-sector roll 34. This arrangement provides much higher precision of feeding operation as compared with the case where a transmission device having large tendency of slipping is used or the case where the intermittent driving device incorporates a gear train consisting of a number of gears which tend to involve backlashes and, hence, a play or lost motion in the operation of the apparatus.

Although the invention has been described through specific terms, it is to be noted here that the described embodiment is not exclusive and various changes and modifications may be imparted thereto without departing from the scope of the invention which is limited solely by the appended claims.

What is claimed is:

1. A roll feed apparatus comprising:

an intermittent driving device including a rocker shaft, a roll release shaft and a brake operation shaft which are adapted to make rocking rotation independently of one another, a main roll shaft and a sub-roll shaft extending in parallel with the rocker shaft, a drive connection device through which said rocker shaft and said main roll shaft are operatively connected to each other in such a manner as to permit an adjustment of the rocking angle of said main roll shaft in relation to the rocking angle of said oscillation shaft, and a pair of sector gears attached to respective one ends of said main roll shaft and said sub-roll shaft, said main roll shaft and said sub-roll shaft being operatively connected to each other through said sector gears;

a combination of a main sector roll attached to the other end of said main roll shaft and a sub-sector roll attached to the other end of said sub-roll shaft, said main sector roll and said sub-sector roll cooperating with each other in clamping therebetween a sheet material to feed the same;

a roll release device operatively connected to said roll release shaft and also to said sub-sector roll, said roll release device being adapted to move, when said rolls are rotated in the directions reverse to the feeding directions, said sub-sector roll away from said main roll thereby to release said sheet material from the clamping force; and a braking device operatively connected to said brake operation shaft and adapted to make, when said rolls are rotated in the directions reverse to the feeding directions, engagement with said sheet material thereby to fix said sheet material against movement.

2. A roll feed apparatus according to claim 1, wherein said roll release device includes a roll housing, a first eccentric shaft, a release arm rotatably fitted at its one end to said first eccentric shaft, said first eccentric shaft being rotatably carried by said roll housing, said release arm being fitted rotatably substantially at its lengthwise central portion to said sub-roll shaft, a pressurizing device for always biasing said release arm to urge said sub-sector roll towards said main sector roll, and a release operation plate fixed to said release shaft and projected to a lateral side of said roll release shaft, said release operation plate being operatively connected at its free end portion to the other end of said release arm, whereby, when said release operation plate is rotated as a unit with said release shaft in one direction, said release operation plate imparts a torque to said release arm to overcome the biasing force of said pressurizing device thereby to move said sub-sector roll away from said main sector roll, while, when said release operation plate is rotated together with said roll release shaft in the other direction, said torque is relieved to permit said sub-sector roll to be moved towards said main sector roll by the biasing force of said pressurizing device.

3. A roll feed apparatus according to claim 2, wherein said braking device includes a second eccentric shaft, first adjusting blocks rotatably fitting around said second eccentric shaft, said second eccentric shaft being rotatably secured to said roll housing at one side of the path of feed of said sheet material, a third eccentric shaft, second adjusting blocks rotatably fitting around said third eccentric shaft, said third eccentric shaft being rotatably secured to said roll housing at the other side of said path of feed of said sheet material, said first and second adjusting blocks opposing to each other across said path of feed of said sheet material, brake arms pivotally secured to said roll housing and operatively connected at their one ends to said first and second adjusting blocks, respectively, said brake arms being provided with a brake pad adapted to make a frictional engagement with said sheet material to fix the latter against movement, and a spring for biasing said brake arms to bring said brake pad into contact with said sheet material, said roll release shaft and said brake operation shaft being operatively connected to said first adjusting blocks and said second adjusting blocks, respectively, whereby the clamping and release of said sheet material by said rolls, as well as fixing and release of said sheet material by said braking device, are achieved at a suitable timing in accordance with the rotation of said roll release shaft and said brake operation shaft.

4. A roll feed apparatus according to any one of claims 1 to 3, wherein said intermittent driving device includes an input cam shaft connected to a driving power source such as a motor, a first cam, second cam and a third cam adapted to be rotated as a unit with said input cam shaft, and a first turret, second turret and a third turret which are held in engagement with said first to third cams, respectively, and adapted to make rocking rotation in accordance with the rotation of said cams, said rocker shaft, roll release shaft and said brake operation shaft are integrally attached to said first turret, second turret and third turret, respectively.

5. A roll feed apparatus according to any one of claims 1 to 3, wherein said drive connection device includes a rocker member attached at its one end to said rocker shaft, a slider mounted in said rocker member to rock as a unit therewith and movable in the axial direction of said rocker member, and a connecting rod through which said slider is connected to said sector gear attached to said main roll shaft, whereby the rocking angle of said main roll shaft with respect to the rocking angle of said rocker member is changed as the displacement of said slider in the axial direction of said rocker member is changed.

6. A roll feed apparatus according to claim 4, wherein said drive connection device includes a rocker member attached at its one end to said rocker shaft, a slider mounted in said rocker member to rock as a unit therewith and movable in the axial direction is said rocker member, and a connecting rod through which said slider is connected to said sector gear attached to said main roll shaft, whereby the rocking angle of said main roll shaft with respect to the rocking angle of said rocker member is changed as the displacement of said slider in the axial direction of said rocker member is changed.

* * * * *